US005371975A

United States Patent [19]

Lundmark

[11] Patent Number: 5,371,975

[45] Date of Patent: Dec. 13, 1994

[54] PROCESS AND DEVICE FOR MACHINE-WORKING OR ROLLS AND SIMILAR WORKPIECES

[75] Inventor: Ebbe Lundmark, Orebro, Sweden

[73] Assignee: E. Lundmark Industrimatningar, Orebro, Sweden

[21] Appl. No.: 949,250

[22] PCT Filed: Mar. 25, 1991

[86] PCT No.: PCT/SE91/00227

§ 371 Date: Nov. 23, 1992

§ 102(e) Date: Nov. 23, 1992

[87] PCT Pub. No.: WO91/14535

PCT Pub. Date: Oct. 3, 1991

[30] Foreign Application Priority Data

Mar. 23, 1990 [SE] Sweden ..... 9000033-2

[51] Int. Cl.[5] ..... B24B 5/04; B24B 5/37; B24B 49/04; B24B 49/14

[52] U.S. Cl. ..... 451/9; 451/6; 451/26; 451/7; 451/49; 451/53

[58] Field of Search ..... 51/49, 165.71, 165.72, 51/165.73, 165.74, 165.75, 165.77, 165.91, 165.92, 289 R, 322

[56] References Cited

U.S. PATENT DOCUMENTS

| | | | |
|---|---|---|---|
| 2,427,064 | 9/1947 | Moul | 51/165.73 |
| 3,147,574 | 9/1964 | La Pointe et al. | 51/165.77 |
| 3,456,394 | 7/1969 | Welsh . | |
| 3,488,887 | 1/1970 | Parrella et al. | 51/49 |
| 3,597,888 | 8/1971 | Kusakabe . | |
| 3,964,210 | 6/1976 | Morimoto | 51/165.91 |
| 4,036,607 | 7/1977 | Freddi | 51/165.91 |
| 4,181,077 | 1/1980 | Dalton | 51/165.91 |
| 4,438,598 | 3/1984 | Wohlmuth | 51/165.73 |
| 4,731,954 | 3/1988 | Lilienfein | 51/165.71 |

FOREIGN PATENT DOCUMENTS

| | | | |
|---|---|---|---|
| 0035627 | 12/1983 | European Pat. Off. . | |
| 0154683 | 9/1985 | European Pat. Off. . | |
| 239161 | 3/1987 | European Pat. Off. . | |
| 3009180 | 3/1980 | Germany . | |
| 3112991 | 1/1982 | Germany . | |
| 3000361 | 9/1987 | Germany . | |
| 4343 | 1/1983 | Japan | 51/165.77 |
| 136492 | 8/1974 | United Kingdom | 51/165.74 |

OTHER PUBLICATIONS

Derwent's Abstract No. 83-769 359/38, SU 973 325, Bul. 42, Nov. 15, 1982, "Grinding Temp. Controller-has IR Radiation Receiver Mounted in Radial Channel of Grindstone Hub".

Yutaka Yamauchi 59-209759, Appl. No. 58-82332, "Size Control Method in Cutting", vol. 9, No. 80, May 10, 1983.

Hideyo Iwata, 60-1184568, Appl. No. 58-227623, "Automatic Dimension Correcting Method for Thermal Displacement of Grinder", vol. 9, No. 275, Nov. 30, 1983.

*Primary Examiner*—Jack W. Lavinder

*Attorney, Agent, or Firm*—Browdy and Neimark

[57] ABSTRACT

A process for machining mils and similar work pieces, especially for grinding the roll surface to a desired shape which process is characterized by continuously meshing the distance between the part of the work piece (1) which is subjected to working and a reference measuring means, preferably a measuring point of the tool or means cooperating therewith, which depends on the position of the working tool (2), with a distance measuring means (4), as well as the temperature of the work piece at or close to the spot of working and/or the distance measuring point with a temperature measuring means (3), submitting signals corresponding to the measured value from the distance and temperature measuring means resp. to a calculating unit (5) which is arranged to calculate the desired size value of the work piece corrected with regard to the temperature measured during the working (actual temperature), and to present (6) at least one of the corrected desired size values (7), the working depth (9) remaining to the corrected desired size value, and the actual size value (8), and/or arranged to automatically control the movement of the tool in relation to the work piece for achieving the desired size of the work piece, corrected to the actual temperature continuously measured during the working. The invention also relates to a device for carrying out this process.

13 Claims, 3 Drawing Sheets

Fig. 1
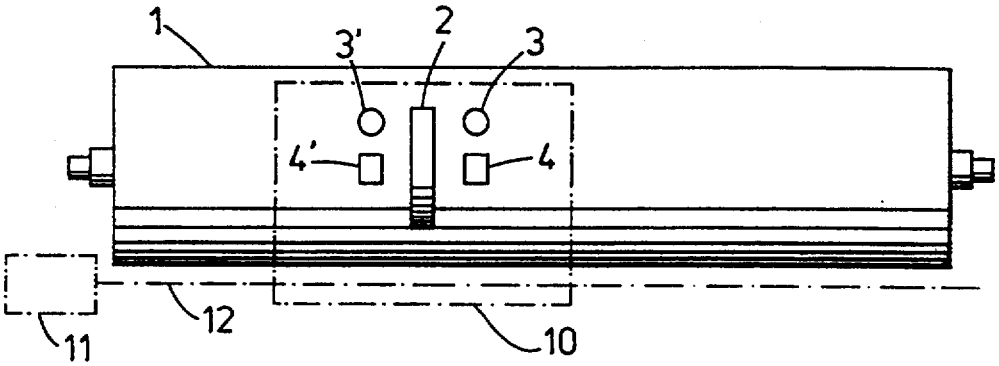
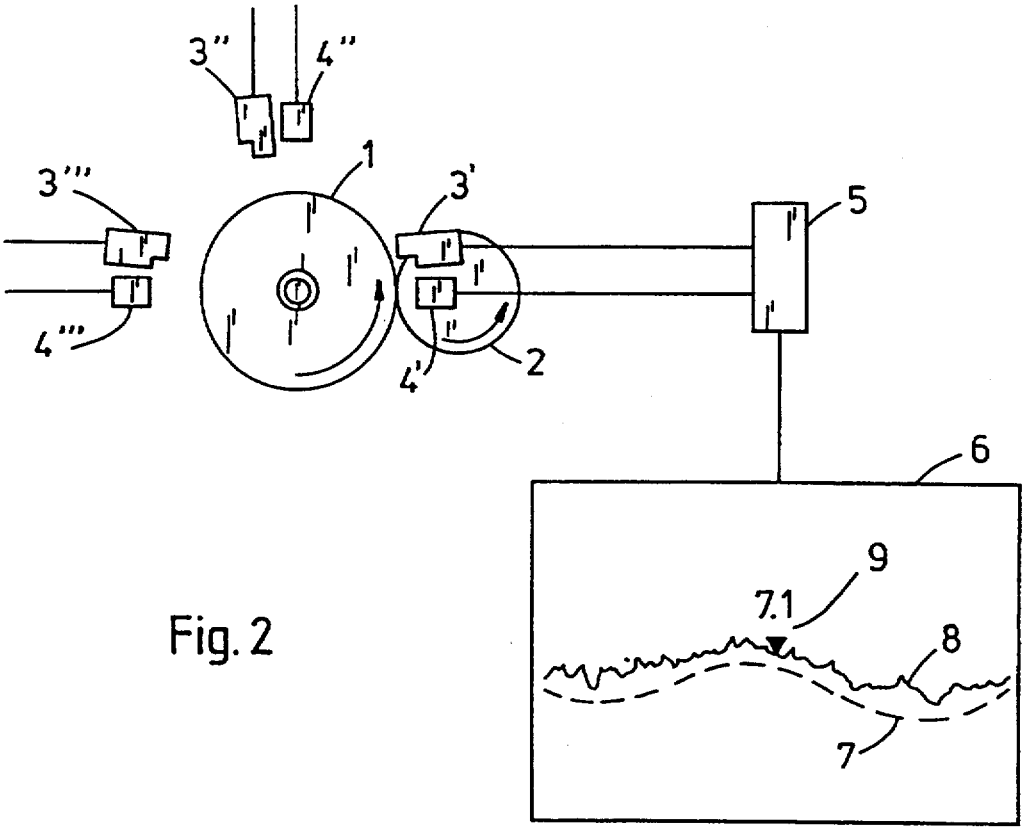
Fig. 2

PROCESS AND DEVICE FOR MACHINE-WORKING OR ROLLS AND SIMILAR WORKPIECES

This invention is related to a process for machining rolls and similar work pieces, especially for grinding the roll surface to desired shape and radius.

It is previously known that in a machining process, such as grinding rolls for which small size tolerances are required, such as rolls used in the paper, plastics and metal industries, temperature variations in the roll influence the grinding and measuring result, and attempts have been made to take into account the roll temperature when grinding the roll. Such previous attempts have, however, had deficiencies, e.g. in that temperature variations created during the working have not been taken into account.

According to this invention it is possible to substantially improve the accuracy and shorten the working time for machine working, such as turning and especially grinding rolls and similar work pieces, by measuring during the working continuously (including also intermittently with small time intervals) the actual size of the work piece close to or preferably at the part of the surface of the work piece where the tool, especially a grinding wheel, contacts the surface of the work piece, in the case of a rotating work piece especially at an area in the same radial plane or within a short axial distance from said plane, e.g. at most 100 mm or at most 10 mm, and also measuring the temperature of the work piece, preferably at or close to those areas where machining and/or measuring the size or distance is performed, with a rotating work piece preferably at an area in the same radial plane or within a short axial distance therefrom, e.g. at most 100 mm or at most 10 mm. From the distance measuring means and temperature measuring means resp. which are used signals corresponding to the measured values are transferred to a calculating unit which is arranged to calculate and preferably present, on the basis of said measured values and other relevant information, e.g. the coefficient of thermal expansion, heat conductivity, heat capacity, etc. of the work piece, which depend on the material, especially roll material, at least one measured value which makes it possible to compare the desired size value of the location being worked with the actual size value thereof taking into consideration the actual temperature during the machining and the distance measuring. Said desired and actual values are suitably recalculated to a common temperature, especially to the measured temperature, but as an alternative to any other suitable temperature, e.g. the temperature at which the roll is intended to be used. This may e.g. be the temperature (temperature zone) in a part of a paper machine in which a roll, which is subjected to machining, is intended to be used, e.g. the temperature at which a wire roll is used. It may, furthermore, generally be suitable or necessary to take into consideration whether various parts of the work piece, e.g. a roll, exhibit different temperatures in use, in which case the desired size values, in case the work piece has another temperature distribution than that which is prevailing in use, should be calculated with corrections made for said differences of the temperature of use.

It is e.g. possible to calculate and preferably also present at least one of, suitably two of and preferably all three of the following values: The desired size value of the work piece corrected to the actual temperature, i.e. the shape of the work piece which is desired, corrected for the actual (prevailing) temperature, the actual (optionally temperature corrected) size value of the work piece and the depth of machining remaining to the desired value.

Preferably two of or all three of said values are presented, e.g. on a display unit as graphs in a coordinate system, whereby preferably also the actual position of the tool in the axial direction is disclosed with a marker on the display unit. Presentation is preferably performed with a suitable scale ratio in the radial/axial direction, e.g. a ratio of at least 500:1, depending, of course, on the size of the difference between the desired and actual size values.

When performing the distance measurements one should also take into consideration possible deformations of the work piece and the influence of gravity, which may be of substantial size, e.g. in case there is a substantial distance between the points of support of an elongated work piece, e.g. a roll. Such deformations are normally reversible, i.e. they vanish as soon as the load ceases to exist.

Any suitable arrangements and methods can be used for measuring distance and temperature. The distance measurements can comprise e.g. the distance from or to a reference line, e.g. the axis of rotation of a work piece or the linear feed axis of a measuring means which is arranged on or moves parallel to a longitudinal feed carriage 10 of a working machine, e.g. a grinding machine, or from a ray of radiation, e.g. a laser ray, or a flat or curved reference plane. Suitable are e.g. measuring devices moving parallel to or arranged on a carriage which supports the working tool, e.g. a grinding wheel. The measurement can e.g. be performed with or without touching (contact with) the work piece and mechanically, electrically (by inductivity and/or capacitivity) or with radiation, preferably electromagnetic radiation, e.g. laser, especially by reflexion against the surface being worked. The temperature can also be measured with or without touching, e.g. with an infrared radiation measuring device or with a contacting means, e.g. a touching rotating roll. The measuring is desirably carried out without touching, i.e. at a distance from the tool, preferably for preventing disturbances of the measurements caused by grinding dust and cooling liquid.

The measurements of temperature and/or distance are preferably performed continuously. The expression continuously comprises preferably also measurements with a shorter time interval during continued machining. The size of the time intervals may vary depending upon the conditions, e.g. to at most 1 minute or at most 10 seconds but are often shorter. The time intervals often correspond to what is required for processing the measured value in question in the calculating unit and/or for presentation.

Simultaneously with or instead of presenting, the measured values can be used for automatic working, either for the entire working or for a coarser preworking or a finishing fine working.

On the enclosed drawings:

FIG. 1 shows schematically an arrangement for grinding the surface of a roll seen in a side view.

FIG. 2 shows the same arrangement seen in the axial direction of the roll and the grinding wheel.

Figure 3:
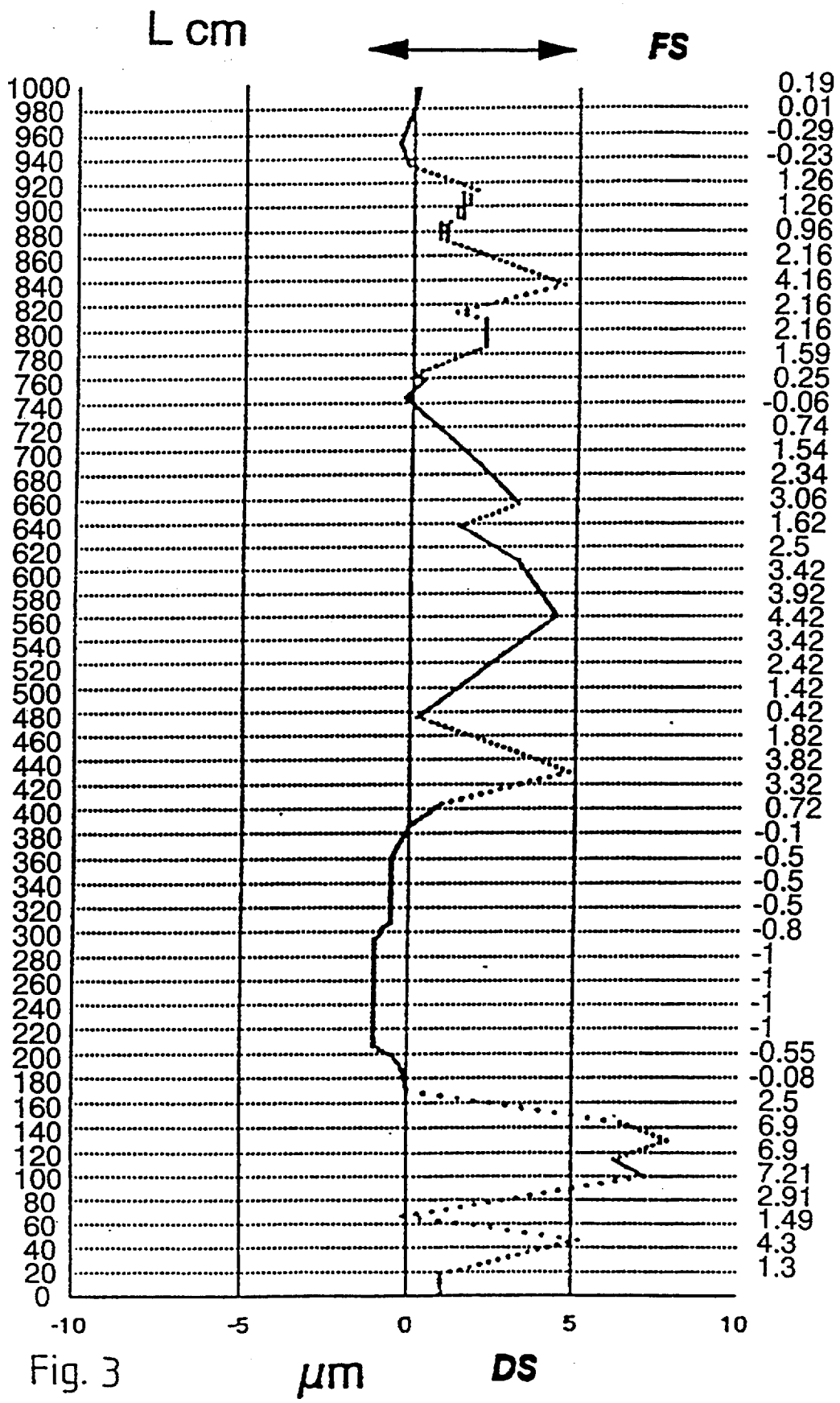
FIGS. 3 and 4 show graphs of measured values for roll grinding.

The Figures show schematically a roll 1 and a grinding wheel 2 arranged on a wheel carriage, not shown, for feeding in the axial and radial directions of the roll. Indicated on said Figure is also a temperature sensing means 3 which is arranged for sensing the temperature of the roll surface, and a distance sensing means which is arranged for measuring the distance between a wheel carriage and the roll surface and thereby measuring variations of the radius (surface profile) of said roll. As is disclosed on FIG. 2 the temperature sensing device 3 and the distance sensing device 4 are connected to a calculating unit 5 which carries out the calculations mentioned previously and presents the results thereof on a display unit 6, on which is shown a line 7 indicating the correct roll profile (desired value) with correction for the temperature, and a line.8 which shows the actual roll profile, and a marker 9 which indicates the actual position along the roll of the grinding wheel, in the case disclosed together with a numerical value indicating the difference between said two lines expressed in microns. The scale in the vertical direction and thereby the distance between said lines can be varied as required so that a clear reading of the difference between the actual and the desired values can be made.

Guided by the displayed surface profile lines the machine operator can operate the feeding of the grinding wheel in the axial and radial directions so that the actual value will become as close as desired to the desired value. Furthermore, also said feeding movements can be controlled automatically with output signals from the calculating unit 5.

Furthermore, the measuring equipment may alternatively also be doubled with corresponding distance sensing means 4' and temperature measuring means 3' on the opposite side of the grinding wheel, in the axial direction, which simplifies measuring at the ends of the roll.

As an example of grinding machines with which the process according to this invention has been tested reference can be made to a machine of the type Johansson 2 U-E, but this invention is, of course, not restricted to the use of said grinding machine. In the grinding machines, in which the invention is used, the grinding wheel may be arranged movable and the work piece stationary, or the work piece may be arranged movable and the grinding wheel stationary, or the grinding wheel as well as the work piece may be arranged movable, in the axial and/or radial direction.

Generally it can also be stated that the dimensions of the rolls can vary, e.g. from the Sendzimir rolls used in metal industry with a diameter of about 35 mm to the press rolls and drying cylinders in paper mills with diameters of a few meters. The material may also vary. Commonly used are steel castings and chill hardened cast iron, e.g. in drying cylinders. Some rolls are coated with rubber, some rolls are bored or grooved with grooves forming a helix. Usually the grinding program may comprise a rapid pre-grinding with high axial direction speed followed by a finishing grinding with an axial speed of e.g. up to about 30 mm per rotation of the roll, preferably about 5–15 mm or 8–10 mm per rotation of the roll with a grinding wheel breadth of about 70 mm. Often the roll is also subjected to a final fine grinding or high gloss grinding. Common for all types of grinding is that it is of great value for the grinding operator to see how the work proceeds and to obtain a quick and correct documentation of the grinding result, as a drawing (plot) of the profile as well as in the form of a table.

Figure 4:
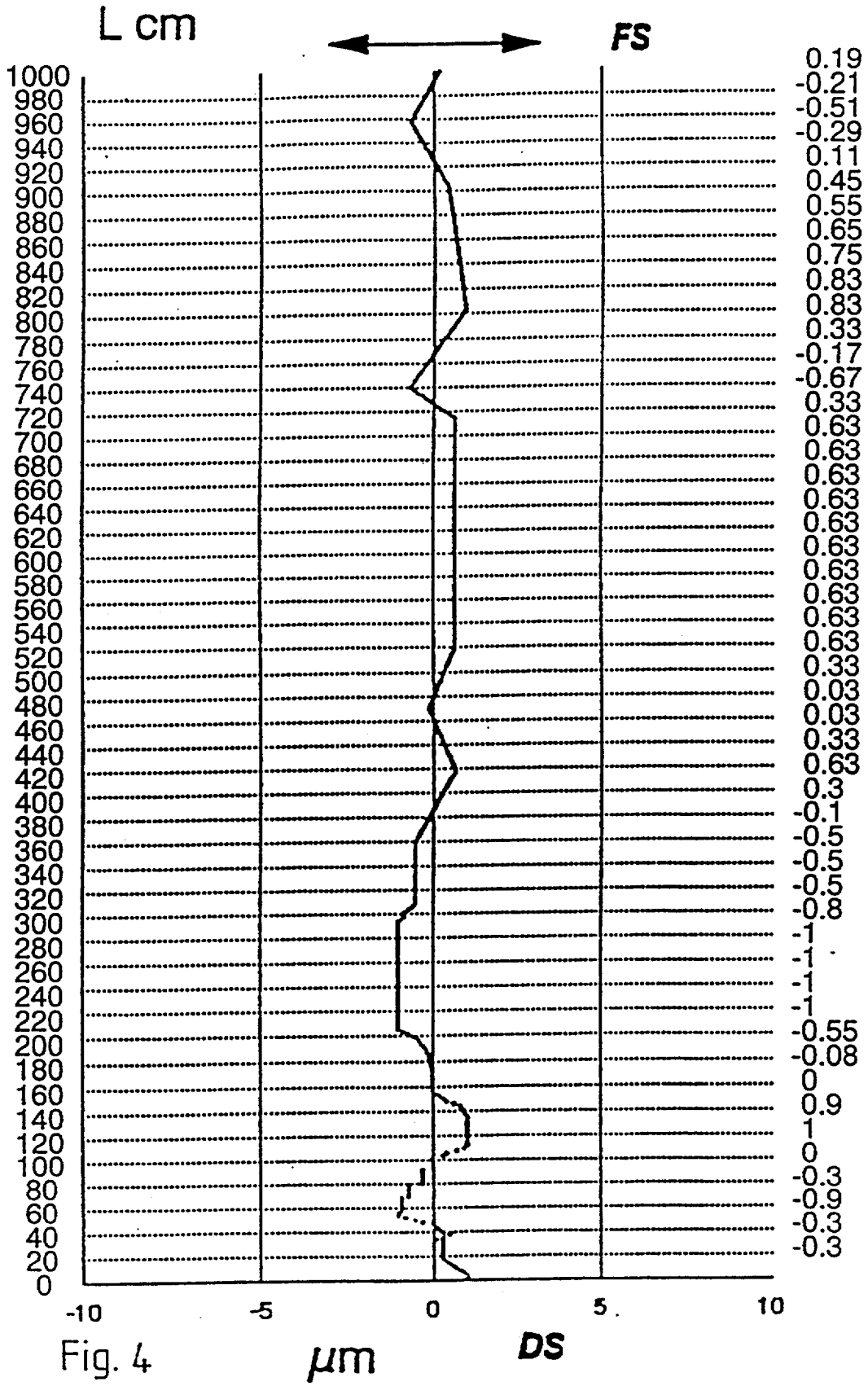

Examples of measured profiles of a smoothing (glazing) roll for a paper machine before and after grinding with the process according to this invention are disclosed on FIGS. 3 and 4.

For measuring the distances it is possible to use e.g. an electro-optical instrument, e.g. "Precimeter" (from Replir AB, Gothenburg) (e.g. a 5 milliampere semiconductor laser). This was used for the measurements disclosed on FIGS. 3 and 4 together with an IR temperature measuring means of the type AHLBORN AMR Therm 2288. The temperature can be measured with an IR measuring means which may be provided with a filter for a suitable wave length area for cutting out light from irrelevant sources. The instrument can easily be adjusted for varying degrees of emission. An angle sensing means 11 on the feed screw 12 of the wheel carriage can submit information concerning the position of the grinding wheel along the roll to the computer. Alternatively it is possible to use, as a position indicating means, a potentiometer connected to the wheel carriage which is turned by a wheel which applies against the bottom wheel of the grinding machine and submits information concerning the position. A revolution counter of the driving shaft of the roll support can be used as a reference measuring means to give the required basis for calculating the change of temperature and cutting per revolution of the rotating roll. Said calculated values are corrected at each passage of the instrument. The cutting can be stated with exact values and the temperature with approximated values. The coefficients of the temperature dissipation between the contact surface of the grinding wheel and the measuring point can be determined with measurement series during the grinding. The calculating unit comprises preferably a computer with a suitable program, which gives flexibility, but it is e.g. also possible to use a suitable, preferably for the purpose especially constructed integrated circuit.

As is disclosed on FIG. 2 the temperature measuring means 3'' and 3''' and the distance measuring means 4'' and 4''' may also be arranged in other positions than those shown with 3 and 4 resp. on FIG. 2, such as above the object subjected to machining (3'', 4'') or diametrically opposite to the working tool (3''', 4'''). The last-mentioned position may be preferable for the distance measuring means if the stiffness of the roll causes substantial bending deflection thereof when the roll is supported at the ends, which is common. The measuring means are suitably arranged in the same axial position (in the same radial plane) as the tool used for working, in which case it may be suitable to arrange some type of wiping means between the working tool and the measuring means for removing any disturbing coatings from the surface subjected to working.

I claim:

1. A process for machining a surface of a work piece, having a longitudinal axis of rotation, to a desired surface profile shape, said process comprising the steps rotating the work piece around said longitudinal axis of rotation and simultaneously subjecting the surface work piece to machining with a machining tool carried on a tool carriage which is movable in relation to the work piece in a direction parallel to said axis of rotation, and thereby providing the surface of the work piece with a desired radius and surface profile along said axis of rotation, continuously measuring (i) said radius and surface profile with distance measuring means and (ii) surface temperature of the roll with temperature measuring means within a spaced axial distance from a part of the work piece where one work piece is being subjected to machining with the machining tool, continuing said machining of the surface of the work piece while moving the machining tool in axial and radial directions relative to the work piece, submitting continuously, while machining said surface, signals from said distance measuring means and temperature measuring means corresponding to the measured distance and temperature to a calculating unit, and continuously calculating from said submitted signals and other relevant information about the roll material, including the thermal expansion thereof, a value which makes it possible to compare the desired radius and surface profile values and the measured radius and surface profile values with correction for the thermal expansion of the roll radius at the measured temperature.

2. A process according to claim 1, further comprising displaying on a display unit at least one of the desired and the measured radius and surface profile values recalculated to a common temperature; and the difference between the desired and measured radius and surface profile values recalculated to a common temperature.

3. A process according to claim 2, wherein information concerning the position of the machining tool along the work piece is submitted to the calculating unit and indicated on the display unit.

4. A process according to claim 1, wherein the work piece which is subjected to machining is a roll intended for use within the field of paper, plastics and metal industries.

5. A process according to claim 1, wherein the machining comprises grinding.

6. A process according to claim 1, wherein the machining comprises turning.

7. A process according to claim 1, wherein the work piece subjected to machining is made from a material selected from the group consisting of cast iron and steel.

8. A process according to claim 1, wherein measuring of the temperature and the radius and surface profile is performed with temperature measuring means and distance measuring means arranged on both sides of the machining tool as seen in the axial direction of the work piece.

9. A machining apparatus for machining a surface of the work piece with a longitudinal axis of rotation, which comprises means for continuously rotating the work piece around its longitudinal axis or rotation, a machining tool carriage carrying a machining tool, means for feeding the machining tool in axial and radial directions relative to the work piece, position indicating means for indicating position of the work piece in the axial direction relative to the machining tool, distance measuring means for continuously measuring radius and surface profile of the work piece, temperature measuring means of the roll, said distance and temperature measuring means being arranged to measure the distance and temperature within a spaced axial distance from a spot of the surface of the work piece in contact with the machining tool, a calculating unit and means for submitting continuously, when machining the surface of the work piece, signals from said distance and temperature measuring means, corresponding to measured distance and temperature to the calculating unit which is arranged to continuously calculate from said submitted signals and other relevant information about the work piece material, including the thermal expansion thereof, an output value of which makes it possible to compare the desired radius and surface profile values with measured radius and surface profile values, with correction for the thermal expansion at the measured temperature of the material of the work piece which is subjected to machining in the device.

10. A machining device according to claim 9, wherein the calculating unit has a display unit and is arranged to display on the display unit at least one of the desired and the measured radius and surface profile values recalculated to a common temperature; the difference between the desired and measured radius and surface profile values recalculated to a common temperature.

11. A machining device according to claim 9, which is a grinding machine arranged for grinding the surface of a rotating work piece in the form of a roll, wherein said machine tool is a grinding wheel.

12. A machining device according to claim 11, which comprises distance measuring means and temperature measuring means on both sides of the grinding wheel as seen in the axial direction of the work piece.

13. A machining device according to claim 9, which is a device for turning the surface of the work piece.

* * * * *